US008267510B2

(12) United States Patent
Kaimoto et al.

(10) Patent No.: US 8,267,510 B2
(45) Date of Patent: Sep. 18, 2012

(54) INKJET RECORDING METHOD

(75) Inventors: Hideki Kaimoto, Shizuoka-ken (JP); Hiroshi Kawakami, Shizuoka-ken (JP); Yoshiyuki Tsuzawa, Kanagawa (JP)

(73) Assignee: FIJIFILM Corporation, Tokyo (JP)

( * ) Notice: Subject to any disclaimer, the term of this patent is extended or adjusted under 35 U.S.C. 154(b) by 424 days.

(21) Appl. No.: 12/560,505

(22) Filed: Sep. 16, 2009

(65) Prior Publication Data

US 2010/0245514 A1 Sep. 30, 2010

(30) Foreign Application Priority Data

Mar. 24, 2009 (JP) ..... 2009-072587

(51) Int. Cl.
*B41J 2/01* (2006.01)

(52) U.S. Cl. ..... 347/104

(58) Field of Classification Search ..... 347/16, 347/101–105
See application file for complete search history.

(56) References Cited

U.S. PATENT DOCUMENTS

| | | | | |
|---|---|---|---|---|
| 5,702,804 | A * | 12/1997 | Malhotra | 428/32.13 |
| 2006/0083870 | A1 * | 4/2006 | Chen | 428/32.34 |
| 2009/0186162 | A1 * | 7/2009 | Namba et al. | 427/511 |
| 2009/0212484 | A1 * | 8/2009 | Kawaguchi et al. | 271/195 |

FOREIGN PATENT DOCUMENTS

| | | | |
|---|---|---|---|
| JP | 2005-119217 | A | 5/2005 |
| JP | 2006-43927 | A | 2/2006 |

* cited by examiner

*Primary Examiner* — Stephen Meier
*Assistant Examiner* — Tracey McMillion
(74) *Attorney, Agent, or Firm* — SOLARIS Intellectual Property Group, PLLC

(57) ABSTRACT

A inkjet recording method is provided in which occurrence of curling at the time of double-sided recording is prevented. In the method, an inkjet recording medium is used which includes resin coated paper having a resin layer A of thickness "a" at one side of base paper, and a resin layer B thinner than the thickness "a" by a thickness of 3 μm to 20 μm at the other side of the base paper, and ink receiving layers each of which includes an inorganic pigment and a binder and are provided at both sides of the resin coated paper; and an image is recorded on the ink receiving layer at the resin layer B side of the resin coated paper, and subsequently an image is recorded on the ink receiving layer at the resin layer A side of the resin coated paper.

10 Claims, 4 Drawing Sheets

INKJET RECORDING METHOD

CROSS-REFERENCE TO RELATED APPLICATION

This application claims priority under 35 USC 119 from Japanese Patent Application No. 2009-072587 filed on Mar. 24, 2009, the disclosure of which is incorporated by reference herein.

BACKGROUND OF THE INVENTION

1. Field of the Invention

The present invention relates to an inkjet recording method for performing double-sided recording.

2. Description of the Related Art

Inkjet recording media, in which a recording layer that receives ink has a porous structure, have been proposed and put to practical use in inkjet recording methods. As an example, there is an inkjet recording medium in which a recording layer, which contains inorganic pigment particles and a water-soluble binder, and has high porosity, is formed on a support. The inkjet recording medium has excellent rapid ink-drying characteristics owing to the porous structure thereof, and is widely used as a material capable of recording photo-like images with high glossiness.

In recent years, the use of such a recording material for inkjet recording for recording images at both surfaces of the recording material is being demanded for commercial prints such as photo books or the like. When images are recorded by spotting ink droplets on both surfaces of a recording medium, in addition enabling the recording of images with high quality and high glossiness at higher speed, it is also important that deformation, such as curling, of the recording medium is not easily caused during recording or after recording, in view of the quality of the recording material.

As a recording material for double-sided recording, an inkjet recording material has been proposed in which the average secondary particle diameter of inorganic ultrafine particles in an inkjet recording layer is 300 nm or less, the average particle diameter of thermoplastic organic polymer fine particles on one surface of the support is 300 nm or less, and the average particle diameter of thermoplastic organic polymer fine particles on the other surface of the support is from 0.1 μm to 10 μm (see, for example, Japanese Patent Application Laid-Open (JP-A) No. 2005-119217). Here, the average secondary particle diameter is 300 nm or less, and the average particle diameter of the thermoplastic organic polymer fine particles on the front surface is different from that of the back surface of the support, so that even if the respective amounts of ink adhered to the front and back surfaces are considerably different from each other, the curling property after printing is favorable, and the glossiness, ozone resistance, image quality and ink absorptivity are excellent.

SUMMARY OF THE INVENTION

However, when an image is printed on one surface of an inkjet recording medium having inkjet image receiving layers (i.e., ink receiving layer) on both surfaces of a liquid-nonabsorbent support and, immediately after that, another image is printed on the other surface of the inkjet recording medium, the surface on which the first image has been printed is not sufficiently dried, so that problems such as the recording medium being curled in the conveyance path of the medium at the time of printing of an image on the back surface of the medium, and contacting parts in the vicinity of an ink ejecting head and, further, the edge of the recording medium being stained with ink, easily arise. Although such problems tend to arise when both surfaces are subjected to high speed processing, similar phenomena may arise when recording is successively performed on both surfaces, even in general-purpose machines.

In particular, since a large amount of an ink solvent remains in an ink receiving layer immediately after printing, and the solvent functions as a plasticizer that plasticizes a binder in the ink receiving layer, minus-curl (i.e., curling of a recording medium in such a manner that the surface on which an image has been formed is the convex surface) is easily generated. Although this phenomenon may be addressed by adding a plasticizer, an adverse effect such as reduction in density may occur to a significant degree.

The present invention has been made in view of the above circumstances, and an object of the invention is to provide an inkjet recording method capable of preventing occurrence of curling of a recording medium at the time of double-sided recording.

In general, in recording materials having a resin layer and/or an ink receiving layer on both surfaces of a substrate such as paper, the configuration of the layers on both surfaces is the same, from the viewpoint of shape-balance of the recording material after completion of printing with respect to curling or the like in a state where images are recorded on the recording material. However, the present inventors have found that, in particular, in a recording system where recording is performed by ejecting ink by an inkjet method, when recording is performed at one side of the substrate and subsequent recording at the other side of the substrate is started immediately after that, a large quantity of an ink solvent remains only at one side of the substrate immediately after the recording is performed at this side of the substrate, thereby causing a change in shape of the recording medium at the time of recording at the other side, and resulting in destabilization of the traveling performance and the travel trajectory of the medium. The invention has been made in view of such findings.

Namely, the exemplary embodiments of the invention are as follows:

(1) An inkjet recording method, including:

preparing an inkjet recording medium which includes a resin coated paper having a resin layer A of thickness "a" at one side of a base paper, and a resin layer B that is thinner than the thickness "a" by a thickness of 3 μm to 20 μm at the other side of the base paper, and ink receiving layers each including an inorganic pigment and a binder and being provided at either side of the resin coated paper;

recording an image on an ink receiving layer at the resin layer B side of the resin coated paper; and subsequently recording an image on an ink receiving layer at the resin layer A side of the resin coated paper.

(2) The inkjet recording method according to (1), wherein the resin layer B is thinner than the resin layer A by a thickness of 5 μm to 10 μm.

(3) The inkjet recording method according to (1), wherein the thickness of each of the ink receiving layers formed at either side of the resin coated paper is from 20 μm to 50 μm.

(4) The inkjet recording method according to (1), wherein the thickness of each of the ink receiving layers formed at either side of the resin coated paper is from 25 μm to 40 μm.

(5) The inkjet recording method according to (1), wherein the recording on the ink receiving layer at the resin layer A side is started within 30 seconds after completion of the recording on the ink receiving layer at the resin layer B side.

(6) The inkjet recording method according to (1), wherein the basis weight of the base paper is 180 g/m$^2$ or less.

(7) The inkjet recording method according to (1), wherein the amount of ink ejected is at least 7 g/m$^2$ or more, when an image is recorded on the ink receiving layer at the resin layer B side.

(8) The inkjet recording method according to (1), wherein the time required for recording an image on the ink receiving layer at the resin layer B side is within 120 seconds from the start of recording.

(9) An inkjet recording method, including:

preparing an inkjet recording medium which includes a resin coated paper having a resin layer A of thickness "a" at one side of a base paper, and a resin layer B that is thinner than the thickness "a" by a thickness of 3 μm to 20 μm at the other side of the base paper, and ink receiving layers each including an inorganic pigment and a binder and being provided at either side of the resin coated paper;

conveying the inkjet recording medium while the inkjet recording medium is suctioned to a conveyance path from the resin layer A side;

recording an image by applying ink by an inkjet recording method onto the ink receiving layer at the resin layer B side of the inkjet recording medium suctioned to the conveyance path;

correcting a curling direction of the inkjet recording medium, on which the image has been recorded, in a direction in which the recorded surface side faces inward in a concave posture;

conveying the curl-corrected inkjet recording medium while it is suctioned to the conveyance path such that the ink receiving layer on which the image has been recorded at the resin layer B side faces the conveyance path; and recording an image by applying ink by an inkjet recording method to the ink receiving layer on which an image has not yet been recorded at the resin layer A side of the inkjet recording medium suctioned to the conveyance path.

(10) An inkjet recording method, including:

preparing an inkjet recording medium which includes a resin coated paper having a resin layer A of thickness "a" at one side of a base paper, and a resin layer B that is thinner than the thickness "a" by a thickness of 3 μm to 20 μm at the other side of the base paper, and ink receiving layers each including an inorganic pigment and a binder and being provided at either side of the resin coated paper, the inkjet recording medium being a roll of an elongated recording medium;

conveying a part of the roll of the recording medium while it is suctioned to a conveyance path from the resin layer A side;

recording an image by applying ink by an inkjet recording method onto the ink receiving layer at the resin layer B side of the recording medium suctioned to the conveyance path;

cutting the recording medium on which the image has been recorded to a predetermined size, at least at the downstream side in the conveyance direction of the image, to form a recording medium sheet;

drying and removing at least a part of ink components from the resulting recording medium sheet;

correcting a curling direction of the recording medium sheet after the drying and removal of the ink components, in the direction in which the recorded surface side faces inward in a concave posture;

conveying the curl-corrected recording medium while the recording medium is suctioned from the resin layer B side such that the front and back surfaces of the curl-corrected recording medium are inverted, and the ink receiving layer on which the image has been recorded at the resin layer B side faces the conveyance path; and recording an image by applying ink by an inkjet recording method onto the ink receiving layer on which an image has not yet been recorded at the resin layer A side of the inkjet recording medium suctioned to the conveyance path.

According to the invention, there is provided an inkjet recording method capable of preventing curling of a recording medium at the time when double-sided recording is performed on the both surfaces of the recording medium. By the method, failure in conveyance of the recording medium and adhesion of ink stain to the recording medium caused by the occurrence of curling, such as the contact of the recording medium with an ink ejecting head during recording, can be prevented.

DETAILED DESCRIPTION OF THE INVENTION

Figure 1:
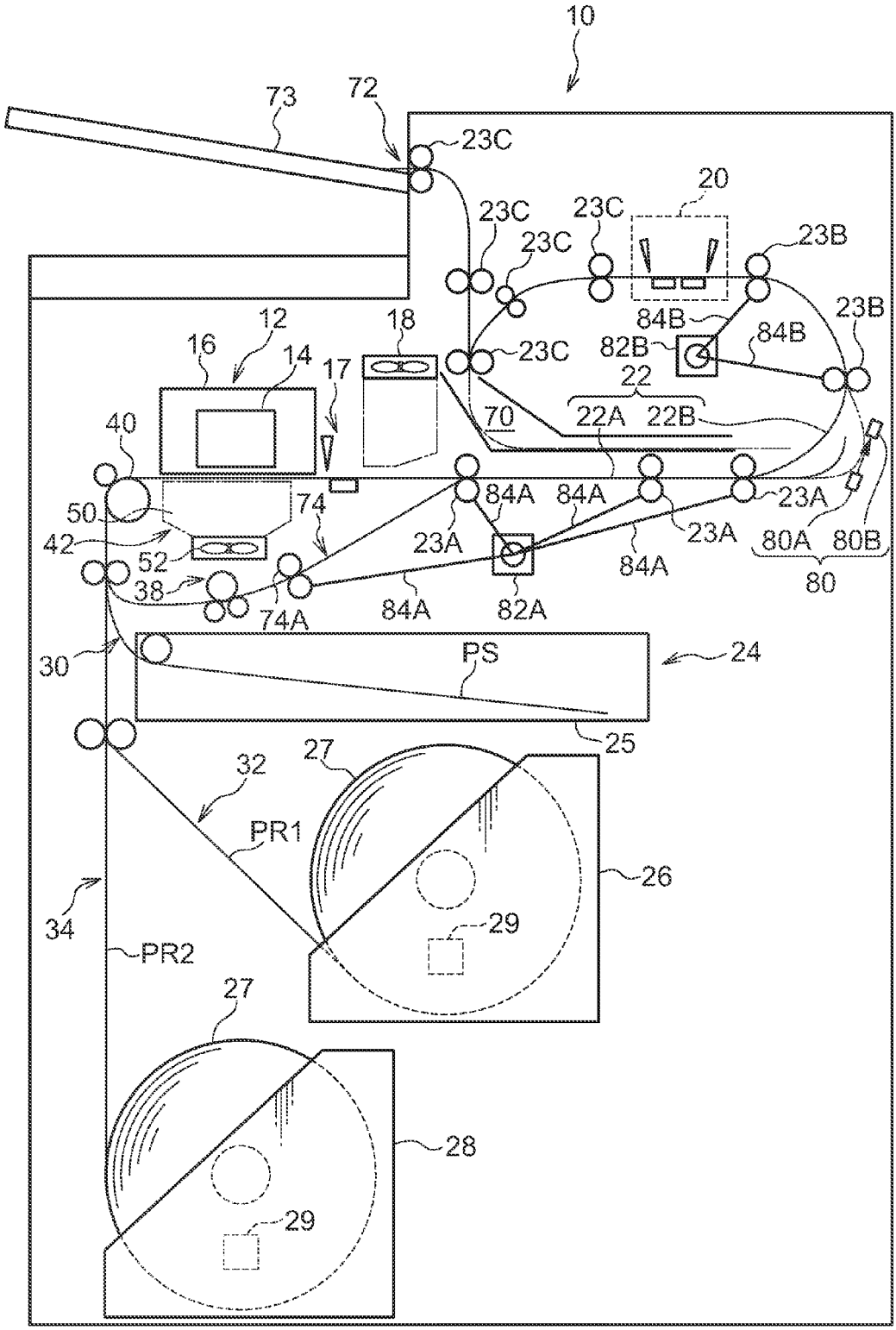
FIG. 1 is a side view showing the configuration of an image recording apparatus according to an exemplary embodiment of the invention.

Hereinafter, the inkjet recording method of the present invention will be described in detail.

In the inkjet recording method of the invention, an inkjet recording medium is used which has at least resin coated paper (hereinafter, may be referred to as "support") having a resin layer A of thickness "a" at one side of base paper, and a resin layer B thinner than the thickness "a" by a thickness of from 3 μm to 20 μm at the other side of the base paper, and ink receiving layers each including an inorganic pigment and a binder and being provided at either side of the resin coated paper, and after an image is recorded on an ink receiving layer at the resin layer B side of the resin coated paper, another image is recorded on an ink receiving layer at the resin layer A side of the resin coated paper.

In the invention, a support has resin layers having different thicknesses which are formed at both sides of base paper, and recording is first performed on the resin layer with a thinner thickness; therefore, temporary unbalance between the front and back sides of the recording medium due to the presence of a large amount of an ink solvent only at one side of the support can be relaxed. Further, in the invention, the thicknesses of the resin layers at both sides are set to predetermined ranges, respectively, so that the balance of the ink solvent between the front and back sides before recording, after one-sided recording and after double-sided recording can be maintained. Thus, occurrence of curling when one-sided recording is performed, and adhesion of ink stain caused by the contact of the recording medium with an ink ejecting head and the like due to the curling can be avoided, and the quality of the recording material can be improved.

In the inkjet recording method of the invention, an inkjet recording medium is used, as a recording material, which has resin coated paper (i.e., support) having a resin layer A of thickness "a" at one side of base paper, and a resin layer B thinner than the thickness "a" by a thickness of from 3 μm to 20 μm at the other side of the base paper; and ink receiving layers provided at both sides of the resin coated paper. The constitutions such as the layer structure, composition, or thickness of the ink receiving layers formed at both sides of the support may be the same as or different from each other. From the viewpoint of curling-preventing effect, in particular, enhancing the effect of relaxing temporary unbalance between the front and back sides due to the presence of a large amount of an ink solvent only at one side of the support, at least the thicknesses of the ink receiving layers at both sides are in the range of from 20 μm to 50 μm, respectively, and it is preferable that the constitutions of the ink receiving layers at both sides are the same.

In the inkjet recording medium to be used in the invention, the thickness of the resin layer A arranged at one side of the support is set to "a" (μm), while the thickness of the resin layer B arranged at the other side of the support is set to a thickness (μm) thinner than the thickness "a" by 3 μm to 20 μm. When the difference between the thickness of the resin layer B and the thickness "a" of the resin layer A is less than 3 μm, the occurrence of curling after recording is performed only on the ink receiving layer at the resin layer B side cannot be suppressed. When the difference between the thickness of the resin layer B and the thickness "a" of the resin layer A exceeds 20 μm, the curling balance before recording or after double-sided recording cannot be maintained, resulting in impairing the quality of the recording medium as a recording material.

In particular, the thickness of the resin layer B is preferably thinner than the thickness of the resin layer A by 5 μm to 10 μm. Meanwhile, the thickness of the ink receiving layers formed at either side is preferably in the range of from 20 μm to 50 μm, and more preferably in the range of from 25 μm to 40 μm.

The thicknesses of the resin layers and the ink receiving layers can be determined by observing the cross-section of specimens cut from samples with a razor or a microtome under an optical microscope.

In the recording onto the inkjet recording medium, an image is recorded on the ink receiving layer at the resin layer B side of the resin coated paper, and subsequently an image is recorded on the ink receiving layer at the resin layer A side. By recording an image at the thinner resin layer side first, unbalance between the front and back sides which occurs when a large amount of an ink solvent is present temporarily only at one side can be relaxed.

At this time, it is desirable that recording on the ink receiving layer at the resin layer A side is started after recording on the ink receiving layer at the resin layer B side is completed, namely, within 60 seconds, preferably within 30 seconds from the time when the recording on the ink receiving layer at the resin layer B side is completed, in view of effectively exerting the effect of the invention. That is, the recording medium is easily deformable within 60 seconds (particularly, 30 seconds) after recording on the ink receiving layer at the resin layer B side is completed because of a large amount of the ink solvent present at one side of the recording medium, and the invention can prevent the occurrence of curling in such a case. Further, an embodiment, in which recording on the ink receiving layer at the resin layer A side is started within 10 seconds after recording on the ink receiving layer at the resin layer B side is completed, is more desirable. In other words, from the viewpoint of exerting the effect of the invention, it is more effective that single-sided recording at one side is completed within a short period of time, in such a case that high speed recording is preformed, or recording is performed on recording medium with a small size, and more specifically, when the recording on the ink receiving layer at the resin layer B side is completed within 120 seconds (preferably, within 40 seconds) from the start of the recording, or recording is performed at a recording speed of 10 seconds/inch or more (more preferably, 3 seconds/inch or more) in the sub-scanning direction, the invention is more effective.

Further, the amount of ink spotted on the ink receiving layer also influences the curling which is easily caused after completion of the recording on the ink receiving layer at the resin layer B side (one side). From the viewpoint of exerting the curl preventing effect more effectively, the amount of ink to be spotted on the ink receiving layer at the resin layer B side (one side) is preferably 7 g/m$^2$ or more, and more preferably 10 g/m$^2$ or more.

In the invention, the start of recording refers to the time when the first ink droplet is spotted on the ink receiving layer, and the completion of recording refers to the time when the last ink droplet is spotted on the ink receiving layer.

Resin Coated Paper

The resin coated paper to be used in the invention has a resin layer B at one side of base paper, and has a resin layer A at the other side, and the compositions of the resin layers A and B may be the same or may be different from each other, but the compositions are preferably the same. Examples of the resin coated paper include resin coated paper, in which both surfaces of base paper are coated with high density or low density polyethylene, polypropylene, polyester or the like by the molten extrusion method or the like.

Base Paper

Base paper is not specifically restricted, but paper generally used can be used as the base paper, and smooth base paper used as the support for photographic use is preferably used. As pulp used for forming the base paper, any one of pulps such as natural pulp, recycled pulp, synthetic pulp and the like may be used alone, or two more kinds of these pulps may be used by mixing thereof.

The base paper is made from wood pulp as a main raw material, and optionally with a synthetic pulp such as polypropylene or synthetic fibers such as nylon or polyester in addition to the wood pulp. As the wood pulp, although any of LBKP, LBSP, NBKP, NBSP, LDP, NDP, LUKP and NUKP may be used, LBKP, NBSP, LBSP, NDP or LDP containing much short fibers is preferably used in a larger amount. However, the content ratio of LBSP and/or LDP is preferably from 10% by mass to 70% by mass with respect to the resulting base paper.

As the pulp, chemical pulp containing less impurities (such as sulfate pulp and sulfite pulp) is preferably used, and pulp that is subjected to a bleaching treatment to improve whiteness is also useful. The base paper may optionally include any of sizing agents such as a higher fatty acid or alkyl ketene dimer; white pigments such as calcium carbonate, talc or titanium oxide; strengthening agents such as starch, polyacrylamide or polyvinyl alcohol; fluorescent brightening agent, water-holding agents such as polyethylene glycol; dispersants, softening agents such as quaternary ammonium, and the like.

The freeness of the pulp used for papermaking is preferably from 200 ml to 500 ml stipulated in the Canadian Standard Freeness (CSF), and as the fiber length after beating, the sum of a 24-mesh remainder % by mass and a 42-mesh remainder % by mass as stipulated in a known test method for classification of pulp with screens (JIS P8207) is preferably from 30% to 70%. Further, a 4-mesh remainder is preferably 20% by mass or less.

The basis weight of the base paper is preferably 250 g/m$^2$ or less, and particularly preferably 180 g/m$^2$ or less, in view of traveling performance at the time of conveyance. The lower limit of the basis weight of the base paper is preferably 30 $g/m^2$ in view of photographic feeling and texture. The basis weight of the base paper is further preferably in the range of from 120 $g/m^2$ to 170 $g/m^2$. The base paper may be subjected to a calender treatment in the process of papermaking or after papermaking to impart smoothness to the base paper. The density of the base paper is generally from 0.7 $g/m^2$ to 1.2 $g/m^2$ (ISO 534 (1998)). Further, the rigidity of the base paper is preferably from 20 g to 200 g under the conditions as stipulated in a known Clark stiffness test method for paper (JIS P8143).

The surface of the base paper may be coated with a sizing agent, and the sizing agent to be coated may be a sizing agent similar to the sizing agent that can be added to the base paper. The pH value of the base paper is preferably from 5 to 9 when measured by the hot water extraction method under the conditions as stipulated in ISO 1924-2 (1994).

The thickness of the base paper is not specifically limited, but the base paper having a smooth surface formed by applying a pressure with calendering or the like to compress the base paper in the papermaking process or after the papermaking process is desirable.

Resin Layer

Examples of materials of the resin layer include homopolymers of olefins such as low density polyethylene, high density polyethylene, polypropylene, polybutene or polypentene; copolymers formed from two or more olefins, such as ethylene-propylene; and mixtures thereof. Polyolefin resin may be used singly, or two or more kinds of polyolefin resins having various densities or melt viscosity indices (melt indices) may be used by mixing thereof.

Further, the resin may include any of white pigments such as titanium oxide, zinc oxide, talc or calcium carbonate; fatty acid amides such as stearic acid amide or arachidic acid amide; fatty acid metal salts such as zinc stearate, calcium stearate, aluminum stearate or magnesium stearate; antioxidants such as IRGANOX 1010, IRGANOX 1076 (registered trademark; manufactured by Ciba Japan K. K.); blue pigments or dyes such as cobalt blue, ultramarine blue, cecilian blue or phthalocyanine blue; magenta pigments or dyes such as cobalt violet, fast violet or manganese purple; and various additives such as a fluorescent brightening agent or an ultraviolet absorber, or may include a combination thereof.

When the resin includes titanium oxide, in general, the amount of titanium oxide is preferably in the range of from 3% by mass to 20% by mass, and more preferably in the range of from 4% by mass to 13% by mass, relative to polyethylene.

The resin layer may be prepared by a so-called extrusion coating method, in which heated and molten resin is casted in a layered form on base paper being conveyed to cover the base paper with the resin. The surface of the base paper is preferably subjected to an activation treatment such as a corona discharge treatment or a flame treatment before the base paper is covered with the resin.

Furthermore, the resin coated paper may be subjected to a calender treatment such as machine calendering, supercalendering, gloss calendering, matt calendering, friction calendering or brush calendering.

Ink Receiving Layer

Each ink receiving layer used in the invention includes at least inorganic particles and a binder, and may further includes another component such as a crosslinking agent for crosslinking the binder or a mordant, if necessary.

The thicknesses of the ink receiving layers of the invention are not specifically restricted, but are each preferably in the range of from 20 μm to 50 μm, and the difference in the thicknesses between the ink receiving layers formed at the both sides of the support is preferably 5 μm or less. The thicknesses of the ink receiving layers are each preferably in the range of from 20 μm to 50 μm, and more preferably in the range of from 25 μm to 40 μm.

Moreover, the ink receiving layer can be formed in a porous structure by containing inorganic particles and a binder. When the ink receiving layer has a porous structure, the effect of the invention is more effectively exerted, and the porosity is preferably from 50% to 80%, the specific surface area is preferably 100 $m^2/g$ or more, and the specific pore volume is preferably 0.5 ml/g or more. Further, the average pore diameter of the ink receiving layer may be 30 nm or less.

Inorganic Particles

The ink receiving layers of the invention each include at least one kind of inorganic particles. Examples of the inorganic particles include amorphous synthetic silica, alumina particles such as amorphous alumina, boehmite or pseudoboehmite, silica/alumina hybrid sol and smectite clay. In particular, in view of the ink absorptivity and image sharpness, alumina particles such as alumina or an alumina hydrate, and amorphous synthetic silica are desirable.

Various kinds of alumina compounds can be used as alumina particles. In general, it has been known that by heating aluminum hydroxides such as gibbsite, bayerite or boehmite, the crystal form thereof is converted to α-alumina through various kinds of intermediates such as $\chi \rightarrow \kappa \rightarrow \alpha$, $\gamma \rightarrow \delta \rightarrow \theta \rightarrow \alpha$, $\eta \rightarrow \theta \rightarrow \alpha$, $\rho \rightarrow \eta \rightarrow \theta \rightarrow \alpha$ or pseudo $\gamma \rightarrow \theta \rightarrow \alpha$, and the particle diameter can be increased (for example, Electrochemistry 28, pp 302 (1960) written by Funaki, and Shimizu).

Further, it has been known that the crystal form is converted from amorphous alumina to α-alumina through intermediate alumina such as γ-alumina, δ-alumina or θ-alumina by pyrolyzing aluminum salts such as aluminum chloride, aluminum sulfate or aluminum nitrate (for example, Mineralogical Journal. 19 (1) pp 21 and pp 41 (1990)).

It is preferable that alumina particles are selected from δ-alumina and γ-alumina, but the shape thereof is not specifically restricted.

In order to disperse or pulverize alumina particles, a homomixer, ultrasonic homogenizer, pressurizing homogenizer, nanomizer, high speed rotary mill, roller mill, container-tumbling media mill, medium agitation mill, jet mill or sand grinder may be used. It is desirable to use a pressurizing dispersion method from the viewpoint of dispersing or pulverizing particles more effectively. Further, when acids such as acetic acid, nitric acid, lactic acid or hydrochloric acid are added, particles can be efficiently dispersed.

The pressurizing dispersion method is a method of passing a slurry mixture of raw material particles continuously at high pressure through an orifice to pulverize the particles, and the processing pressure is preferably from $19.6\times10^6$ Pa to $343.2\times10^6$ Pa, is more preferably from $49.0\times10^6$ Pa to $245.3\times10^6$ Pa, and is still more preferably from $98.1\times10^6$ Pa to $196.2\times10^6$ Pa. When particles are subjected to a high-pressurizing processing, desirable dispersion or pulverization can be achieved.

Further, it is more desirable to use a dispersing or pulverizing method, in which slurry mixture is subjected to counter collision by passing the slurry mixture through an orifice at high pressure. In the method of using the counter collision, dispersion liquid is introduced into an inlet by pressurizing the dispersion liquid, the dispersion liquid is branched in two flow paths, and further, the flow paths are narrowed with orifices, whereby the dispersion liquid is subjected to counter collision to be pulverized with accelerated flow rate. It is preferable to use diamond as a material which constitutes members for accelerating or pulverizing the dispersion liquid from the viewpoint of suppressing the wear of the material. As the high-pressure pulverizing machine, a pressurizing homogenizer, ultrasonic homogenizer, microfluidizer, and a nanomizer are used, and the microfluidizer and nanomizer are desirable as the high-speed collision homogenizer.

As alumina particles, particles of alumina hydrate may be selected. For example, the compounds represented by the following Formula 1 are exemplified.

$$Al_2O_3.nH_2O \qquad \text{Formula 1}$$

Alumina particles are classified into gibbsite, bayerite, nordstrandite, boehmite, pseudoboehmite, diaspore, amorphous noncrystalline amorphous and the like according to the difference in the composition or crystal form thereof. In particular, boehmite and pseudoboehmite are desirable. In Formula 1, when the value of n is 1, Formula 1 represents alumina particles having boehmite structure, and when the value of n exceeds 1 and less than 3, Formula 1 represents alumina particles having pseudoboehmite structure. When the value of n exceeds 3, Formula 1 represents amorphous alumina particles.

Desirable alumina particles are alumina particles having pseudoboehmite structure where at least the n value exceeds 1 and is less than 3.

Aluminum particles are preferably xerogel formed from the alumina particles in view of high ink absorptivity, and the pore volume of the xerogel is preferably from 0.3 ml/g to 0.8 ml/g, and is more preferably from 0.4 ml/g to 0.6 ml/g. When an ink receiving layer is formed, the amount of solvent absorption in the ink receiving layer per unit area is preferably 5 ml/m or more, and is more preferably 10 ml/m or more, from the viewpoint of preventing ink overflow.

The specific surface area of alumina particles is desirably in the range of from 70 $m^2/g$ to 300 $m^2/g$ in terms of the specific surface area measured by the BET method. When the specific surface area is 70 $m^2/g$ or more, alumina particles can be suitably dispersed, and when the specific surface area is 300 $m^2/g$ or less, dye in the ink can be effectively fixed and an image with suppressed ink blur can be obtained.

The shape of alumina particles may be any of tabular, fibrous, needle-like, spherical and rod-like shapes, but the tabular shape is desirable from the viewpoint of the ink absorptivity. The average aspect ratio of tabular alumina particles is preferably from 3 to 8, and is more preferably from 3 to 6. The aspect ratio is represented by the ratio of the "diameter" to the "thickness" of the particles. Here, the diameter of particle refers to the diameter of a circle equivalent to the projection area of the particle when alumina particles are observed under an electron microscope. When the average aspect ratio is 3 or more, the pore size distribution of the ink receiving layer become wider and good ink absorptivity can be attained, and when the average aspect ratio is 8 or less, alumina particles with uniform shape can be obtained.

Alumina particles can be manufactured by known methods such as hydrolysis of aluminum alkoxide such as aluminum isopropoxide, neutralization of aluminum salt with alkali or hydrolysis of aluminate. Examples of the aluminum alkoxide include aluminum isopropoxide, aluminum propoxide and aluminum 2-butoxide.

Further, the particle diameter of alumina particles, the pore diameter, the pore volume, the specific surface area, the number of surface hydroxyl groups and the like can be controlled by adjusting the temperature of precipitation, ripening time, pH value of liquid, liquid concentration, coexisting salts and the like.

The alumina particles may be obtained by any of the methods for hydrolyzing aluminum alkoxides as disclosed in JP-A Nos. 57-88074, 62-56321, 4-275917, 6-64918, 7-10535, 7-267633, U.S. Pat. No. 2,656,321, Am. Ceramic Soc. Bull., 54, 289 (1975), and the like.

In addition to the above, there are methods as disclosed in JP-A Nos. 54-116398, 55-23034, 55-27824 and 56-120508, in which inorganic salts or hydrates of aluminum as raw materials are used for obtaining alumina particles. Examples of the inorganic salts include aluminum chloride, aluminum nitrate, aluminum sulfate, polyaluminum chloride, ammonium alum, sodium aluminate, potassium aluminate and aluminum hydroxide, and the hydrates thereof may also be used.

The amorphous synthetic silica (hereinafter, may be referred to as silica particles) can be roughly classified into the wet process silica, vapor phase process silica, and others according to the manufacturing processes.

The wet process silica is further classified into the precipitation process silica, gel process silica and sol process silica according to manufacturing processes. Among them, the precipitation process silica is manufactured as follows: first, sodium silicate is allowed to react with sulfuric acid under alkaline conditions; silica particles are grown, aggregated and precipitated; and thereafter, the silica particles are subjected to filtration, washing, drying, pulverization and classification to produce a commercial silica product. Examples of the precipitation process silica include NIPSIL ((trade name) manufactured by Tosoh Silica Corporation) and TOKUSIL ((trade name) manufactured by Tokuyama Corporation). The gel process silica is manufactured by allowing sodium silicate to react with sulfuric acid under acidic conditions. Micro particles are dissolved during ripening process, and are reprecipitated so as to combine with other primary particles together; therefore, distinct primary particles disappear and relatively hard aggregated particles with inner void structures are formed. Examples of the gel process silica include NIPSIL ((trade name) commercially available from Tosoh Silica Corporation), and SYLOID and SYLOJET ((trade names) commercially available from W. R. Grace & Co.). The sol process silica is also called colloidal silica, and can be obtained by double decomposition of sodium silicate using an acid, or by heating and ripening silica sol obtained by being passed through an ion exchange resin layer, and for example, SNOWTEX (trade name) commercially available from Nissan Chemical Industries, Ltd. is exemplified.

The vapor phase process silica is also called dry process silica by contrast with the wet process silica, and in general, is manufactured by the flame hydrolysis method. More specifically, although a method, in which silicon tetrachloride is burned together with hydrogen and oxygen, is generally known, silanes such as methyl trichlorosilane or trichlorosilane in place of silicon tetrachloride can be used alone or in a state where silanes are mixed with silicon tetrachloride. Examples of the vapor phase process silica include AEROSIL (trade name) commercially available from Nippon Aerosil Co., Ltd., and REOROSIL QS series (registered tradename) commercially available from Tokuyama Corporation.

The vapor phase process silica is suitably used by dispersing the vapor phase process silica to an average secondary particle diameter of 500 nm or less, preferably from 10 nm to 300 nm, and more preferably from 20 nm to 200 nm in the presence of a cationic compound. As the method of dispersing the vapor phase process silica, it is preferable that the vapor phase process silica is preliminary dispersed with a dispersion medium by general propeller agitation, turbine agitation, momomixer agitation or the like, and subsequently, the preliminary dispersed silica is dispersed by use of a media mill such as a ball mill, bead mill or sand grinder, a high-pressure dispersing machine such as a high pressure homogenizer or ultra-high pressure homogenizer, an ultrasonic dispersing machine and a thin film rotary dispersing machine.

Further, the average particle diameter of the primary particle of the vapor phase process silica is preferably 50 nm or less, and is more preferably from 5 nm to 30 nm.

The vapor phase process silica is desirable in view of obtaining high ink absorptivity, since the vapor phase process silica is present in a state where primary particles are connected with one another in a network structure or chain structure to form a secondary aggregated state. Since the primary particle diameter of the vapor phase process silica is very small, high-definition images can be obtained.

The average secondary particle diameter of inorganic particles can be measured by the dynamic light-scattering method. In the dynamic light-scattering method, particles in a dispersion medium are irradiated with light emitted from a semiconductor laser, and the particle diameter is analyzed based on the light reflected from the particles, and the diameter of an aggregated particle as a whole can be obtained. The average secondary particle diameter with the dynamic light-scattering method is measured by the use of COULTER N4 ((trade name) manufactured by Beckman Coulter, Inc.).

In the dispersion of inorganic particles such as the vapor phase process silica, a cationic compound may be used. Examples of the cationic compounds include cationic polymers and water-soluble metal compounds.

Preferable examples of the cationic polymers include polyethyleneimine, polydiallylamine, polyallylamine, alkylamine polymer, and polymers having primary-tertiary amino groups or quaternary ammonium salt groups as disclosed in JP-A Nos. 59-20696, 59-33176, 59-33177, 59-155088, 60-11389, 60-49990, 60-83882, 60-109894, 62-198493, 63-49478, 63-115780, 63-280681, 1-40371, 6-234268, 7-125411 and 10-193776. In particular, as cationic polymers, diallylamine derivatives are desirable. The molecular weight of these polymers is preferably from about 200 to about 100,000, and particularly, from about 2,000 to about 30,000, in view of the dispersibility and the viscosity of the dispersion.

Examples of the water-soluble metal compounds include water-soluble polyvalent metal salts, and among them, compounds of aluminum or the group 4A metals (for example, zirconium or titanium) in the periodic table is desirable. Water-soluble aluminum compounds are particularly preferable. Examples of the water-soluble aluminum compounds include aluminum chloride or hydrate thereof, aluminum sulfate or hydrate thereof and ammonium alum, as inorganic salts. Furthermore, basic polyaluminum hydroxide compounds as inorganic aluminum-containing cationic polymer are also preferable.

In addition to the above, various known pigments as inorganic particles may be used, and examples of the inorganic pigments include aluminum silicate, magnesium silicate, magnesium carbonate, light calcium carbonate, heavy calcium carbonate, kaolin, talc, calcium sulfate, barium sulfate, titanium dioxide, zinc oxide, zinc sulfide, zinc carbonate, satin white, diatom earth, calcium silicate, aluminum hydroxide, lithopone, zeolite, hydrated halloysite and magnesium hydroxide.

The amount of inorganic particles in the ink receiving layer is desirably in the range of from 55% by mass to 75% by mass relative to the solid content of the layer, from the viewpoint of forming a porous structure with high porosity and imparting high ink absorptivity.

Binder

The ink receiving layer of the invention includes at least one kind of binders. A porous layer can be formed by containing a binder together with the inorganic particles.

Examples of the binder include aqueous binders including polyvinyl alcohol, polyvinyl acetate, oxidized starch, etherified starch; cellulose derivatives such as carboxymethyl cellulose or hydroxyethyl cellulose; casein, gelatin, soybean protein; and thermosetting synthetic resins such as silyl-modified polyvinyl alcohol, melamine resin or urea resin.

Any one of the binders may be used alone, or two or more of the binders may be used in combination by mixing thereof. Further, a cationic resin may be used together for the purpose of fixing a dye.

When silica particles are used as the inorganic particles in the invention, polyvinyl alcohol is desirably used since it has a hydroxyl group in its structure, and a three-dimensional network structure having secondary particles of silica particles as chain units is easily formed owing to formation of hydrogen bonds between silanol groups on the surface of the silica particles and the hydroxyl groups.

The amount of the binder (particularly, polyvinyl alcohol) in the ink receiving layer is preferably from 9% by mass to 40% by mass, and is more preferably from 12% by mass to 33% by mass, relative to the total solid content of the ink receiving layer. When the amount of the binder is in the above range, cracks at the time of drying can be suppressed and favorable film strength and ink absorptivity can be obtained.

The total amount of the binder in the ink receiving layer can be suitably adjusted according to the characteristics of the inkjet recording medium, but is preferably from 5% by mass to 60% by mass relative to 100 parts of the inorganic particles. Further, the coating amount (dried solid amount) of a coating liquid for forming the ink receiving layer is preferably from 5 $g/m^2$ to 50 $g/m^2$.

Other Components

In addition to the inorganic particles and binder, the ink receiving layer may contain other components such as a crosslinking agent, high boiling point organic solvent, pigment dispersing agent, thickener, flowability improving agent, defoaming agent, foaming inhibitor, releasing agent, foaming agent, penetrant, coloring dye, coloring pigment, fluorescent brightening agent, ultraviolet absorber, antioxidant, antiseptic, mildew-proofing agent, dye-fixing agent (e.g., cationic polymer), wet paper strengthening agent or dry paper strengthening agent.

Moreover, for the purpose of increasing the dispersibility of the inorganic particles, the ink receiving layer may contain any of various inorganic salts and an acid or alkali as a pH adjuster.

Suitable crosslinking agent may be appropriately selected in consideration of the binder, and boron compounds are desirable in view of rapid crosslinking reaction. Examples of the crosslinking agents include borax, boric acid, borates (for example, ortho borates, $InBO_3$, $ScBO_3$, $YBO_3$, $LaBO_3$, $Mg_3(BO_3)_2$ and $CO_3(BO_3)_2$), diborates (for example, $Mg_2B_2O_5$, and $CO_2B_2O_5$), metaborates (for example, $LiBO_2$, $Ca(BO_2)_2$, $NaBO_2$ and $KBO_2$), tetraborates (for example, $Na_2B_4O_7.10H_2O$), pentaborates (for example, $KB_5O_8.4H_2O$, $Ca_2B_5O_{11}.7H_2O$ and $CsB_5O_5$) and the like. Among them, boric acid or salts thereof are desirable, and are particularly preferable when polyvinyl alcohol is contained as a binder.

The amount of the crosslinking agent is preferably from 0.05 part by mass to 0.50 part by mass with respect to 1.0 part by mass of a binder (in particular, polyvinyl alcohol).

Further, when gelatin is used as a binder, compounds other than the boron compounds may be used. Examples of such compounds include aldehyde compounds such as formaldehyde, glyoxal or glutaraldehyde; ketone compounds such as diacethyl or cyclopentane dione; active halogen compounds such as bis(2-chloro ethylurea)-2-hydroxy-4,6-dichloro-1,3,5-triazine or sodium 2,4-dichloro-6-S-triazine; active vinyl compounds such as divinyl sulfonic acid, 1,3-vinylsulfonyl-2-propanol, N,N'-ethylenebis(vinylsulfonylacetamide) or 1,3,5-triacryloyl-hexahydro-s-triazine; N-methylol compounds such as dimethylol urea or methylol dimethyl hydantoin; melamine resins (for example, methylol melamine or alkylated methylol melamine); epoxy resins; isocyanate compounds such as 1,6-hexamethylenediisocyanate; aziridine compounds; carboxylmide compounds; epoxy compounds such as glyceroltriglycidyl ether; ethylene imino compounds such as 1,6-hexamethylene-N,N'-bisethylene urea; halogenated carboxyaldehyde compounds such as mucochloric acid or mucophenoxychloric acid; dioxane compounds such as 2,3-dihydroxy dioxane; metal-containing compounds such as titanium lactate, aluminum sulfate, chromium alum, potassium alum, zirconyl acetate or chromium acetate; polyamine compounds such as tetraethylene pentamine; hydrazide compounds such as adipic hydrazide; and low molecular compounds or polymers containing two or more oxazolidine groups.

The ink receiving layer may contain a high boiling point organic solvent to further prevent the occurrence of curling. The high boiling point organic solvents are preferably water-soluble solvents. Examples of water-soluble high boiling point organic solvents include alcohols such as ethylene glycol, propylene glycol, diethylene glycol, triethylene glycol, glycerin, diethylene glycol monobutyl ether (DEGMBE), triethylene glycol monobutyl ether, glycerin monomethyl ether, 1,2,3-butane triol, 1,2,4-butane triol, 1,2,4-pentane triol, 1,2,6-hexane triol, thiodiglycol, triethanol amine and polyethylene glycol (having a weight average molecular weight of 400 or less). Diethylene glycol monobutyl ether (DEGMBE) is preferable.

Exemplary embodiments of the inkjet recording medium of the invention include: (1) preferably, an embodiment where the thickness of the resin layer B is thinner than the thickness "a" of the resin layer A by 5 μm to 20 μm, and the thicknesses of the ink receiving layers at the both sides are each preferably in the range of from 20 μm to 50 μm; (2) more preferably an embodiment where the compositions of the resin layers A and B are the same, the thickness of the resin layer B is thinner than the thickness "a" of the resin layer A by 5 μm to 15 μm, and the thicknesses of the ink receiving layers at the both sides are the same and are in the range of from 25 μm to 45 μm; and (3) still more preferably, an embodiment where the compositions of the resin layers A and B are the same, the thickness of the resin layer B is thinner than the thickness "a" of the resin layer A by 5 μm to 10 μm, the thicknesses of the ink receiving layers at the both sides are the same and are in the range of from 25 μm to 40 μm, and the porosity of each of the ink receiving layers is 55% to 70%.

The ink receiving layer can be formed by coating with a coating liquid for forming an ink receiving layer. The coating with the coating liquid can be performed, for example, by known coating methods using coaters such as an extrusion die coater, air doctor coater, blade coater, rod coater, knife coater, squeeze coater, reverse roll coater or bar coater.

As the method of spotting ink droplets at the time of recording, any methods such as a method, in which an image is recorded by spotting ink droplets being consecutively ejected, on an ink receiving layer by deflecting the droplets in accordance with the image, or a method, in which ink droplets are spotted on an ink receiving layer only in the area for forming an image, namely, a so-called on-demand method, may be selected. The on-demand method may be any methods, in which ink pressure is generated due to the deformation of structural body by use of a piezoelectric element or the like, or ink is ejected with the pressure generated by the expansion of the ink due to the vaporization of the ink by applying heat energy to the ink. Further, a method, in which ejection of ink is controlled by an electric field, may be used.

The nozzle used for ejecting ink is not specifically restricted, it is preferable to use a head having a head unit with plural nozzle arrays or a so-called full-line head having a length equivalent to or longer than the width of an image (inkjet recording medium) in high speed recording, in view of exerting the effect of the invention effectively.

The inkjet recording method of the invention is preferably performed according to a first exemplary embodiment or a second exemplary embodiment as described bellow.

The inkjet recording method according the first exemplary embodiment includes: conveying an inkjet recording medium while the inkjet recording medium is suctioned from the resin layer A side thereof to a conveyance path (first suction-conveying step); recording an image by applying ink by an inkjet recording method onto an ink receiving layer at the resin layer B side of the inkjet recording medium suctioned to the conveyance path (first ink applying step); correcting a curling direction of the inkjet recording medium, on which the image has been recorded, in the direction where the recorded surface side faces inward in a concave posture (curling correction step); conveying the curl-corrected inkjet recording medium while is suctioned to the conveyance path such that the ink receiving layer, on which the image has been recorded, at the resin layer B side faces the conveyance path (second suction-conveying step); and recording an image by applying ink by an inkjet recording method onto an ink receiving layer, on which an image has not yet been recorded, at the resin layer A side of the inkjet recording medium suctioned to the conveyance path (second ink applying step).

According to the first exemplary embodiment, after an image is recorded on the ink receiving layer at the thinner resin layer B side while the inkjet recording medium is suctioned from the thicker resin layer A side thereof, subsequently, another image is recorded on the ink receiving layer at the resin layer A side. Therefore, when the curling direction of the inkjet recording medium is corrected such that a recorded surface side thereof faces inward in a concave posture, for example, when an inkjet recording medium, in which the surface at the resin layer B side is curled in a convex posture, is subjected to a decurling processing to form a state where the surface at the resin layer B side is curled in a concave posture, the suction of the inkjet recording medium from the resin layer B side thereof is favorably performed at the time of recording the image on the ink receiving layer at the resin layer A side, thereby preventing the inkjet recording medium from being brought into contact with members in a machine or from occurrence of ink stain.

Further, when the inkjet recording medium has an elongated form, and is a roll of recording medium, a second exemplary embodiment is applied. The inkjet recording method according to the second exemplary embodiment of the invention preferably includes: conveying an unrolled portion of a roll-shaped recording medium while the unrolled portion of a roll-shaped recording medium is suctioned from the resin layer A side thereof to a conveyance path (first suction-conveying step); recording an image by applying ink by an inkjet recording method onto an ink receiving layer at the resin layer B side of the portion of the recording medium suctioned to the conveyance path (first ink applying step);

cutting the portion of the recording medium, on which the image has been recorded, in a predetermined size, at least at the downstream side of the conveyance direction of the image to form a recording medium sheet (cutting and forming step); drying and removing at least a part of ink components from the formed recording medium sheet (drying and removing step); correcting the curling direction of the recording medium sheet after being dried, in the direction where the recorded surface side thereof faces inward in a concave posture (curling correction step); conveying the curl-corrected recording medium sheet while the recording medium sheet is suctioned from the resin layer B side such that the front and back surfaces of the curl-corrected recording medium sheet are inverted, and the ink receiving layer, on which the image has been recorded, at the resin layer B side faces the conveyance path (second suction-conveying step); and recording an image by applying ink by an inkjet recording method onto an ink receiving layer, on which an image has not yet been recorded, at the resin layer A side of the inkjet recording medium sheet suctioned to the conveyance path (second ink applying step).

In the second exemplary embodiment, in order to record an image on the ink receiving layer at the resin layer B side, and then record another image on the ink receiving layer at the resin layer A side, after at least a part of ink component is dried and removed from the recording medium which has been cut and formed into a recording medium sheet having a predetermined size, the curling direction of the inkjet recording medium sheet is corrected in the direction where the recorded side faces inward in a concave posture in a manner similar to the first exemplary embodiment, and further, the front and back sides are inverted. Therefore, the suction from the resin layer B side is favorably performed when the image is recorded on the ink receiving layer at the resin layer A side, thereby preventing the inkjet recording medium (i.e., recording medium sheet) from being brought into contact with members in the machine or from occurrence of ink stain.

More concrete exemplary embodiments will be described based on the first and second exemplary embodiments as preferable embodiments of the inkjet recording method according to the invention with reference to FIGS. 1 to 3. In the embodiments, a reversal conveyance path having a decurling section in which the curling direction is reversed (decurling) is arranged, and after an image is recorded on an ink receiving layer at the resin layer B side of the resin coated paper, the recording medium is decurled and inverted, and an image is recorded on an ink receiving layer at the resin layer A side by using again the same conveyance path and image recording unit as those in the recording of the image on the ink receiving layer at the resin layer B side.

As shown in FIG. 1, an image recording apparatus 10 is equipped with an image recording section 12 that records an image on recording paper. The image recording section 12 has at least an inkjet recording head 14 that ejects ink droplets towards an inkjet recording medium (hereinafter, may be referred to as "recording paper"), and a carriage 16 that holds the inkjet recording head 14. Although the embodiment is described as a color image recording apparatus 10 that records an image with four colors of Y (yellow), M (magenta), C (cyan) and K (black), the apparatus is also applicable to a monochromatic image recording apparatus, or an image may be recorded with other colors such as R (red), G (green) or B (blue).

Further, the image recording apparatus 10 includes a rear end cutter 17 that cuts the rear end of an image part of an elongated recording paper (downstream side in the conveyance direction of an image recorded on the recording paper being conveyed), which will be described hereinafter, a dryer 18 that solidifies ink droplets by blowing drying air to the surface of the recording paper, on which the image has been recorded with an inkjet recording head 14, a cutter 20 that cuts the recording paper for each image, and a main conveyance path 22 through which the recording paper is conveyed to the rear end cutter 17, the dryer 18 and the cutter 20, sequentially. Here, in FIG. 1, the cutter 20 includes two blades, but the number of the blades may be one.

A horizontal section 22A through which the recording paper is conveyed in the horizontal direction is arranged in the main conveyance path 22. In the horizontal section 22A, an image forming position with the inkjet recording head 14, a cutting position with the rear end cutter 17 and a blowing position of dry air from the dryer 18 are arranged in this order, sequentially. Further, plural roller pairs 23A that convey the recording paper in accordance with the processing speed of the image recording with the inkjet recording head 14 are arranged in the horizontal section 22A.

Further, in the main conveyance path 22, a curving section 22B that changes the conveyance direction of the recording paper being conveyed in the horizontal direction to an upward direction with a predetermined curvature in a U-posture and that curves the recording paper, is arranged. Plural roller pairs 23B that convey the recording paper in accordance with the cutting process speed with the cutter 20 are arranged in the changing and curving section 22B. The curving section 22B is capable of holding the recording paper temporarily by suspending the conveyance of the recording paper temporarily, and curving the recording paper outward. In the present exemplary embodiment, the conveyance of the recording paper is temporarily suspended at the portion where the conveyance direction of the recording paper is first changed. A paper sensor 80 is arranged in the curving section 22B, and the paper sensor detects the recording paper at the position where the recording paper is curved outward by holding one sheet of the recording paper in terms of the maximum recordable image. For example, the paper sensor 80 has at least a light emitting element 80A and a light receiving element 80B which face each other, and the recording paper is detected in such a manner that the light receiving element 80B detects that the light emitted from the light emitting element 80A is intercepted by the recording paper.

The recording paper passed through the curving section 22B is conveyed to the cutter 20, and is cut into each image. The recording paper P cut for each image with the cutter 20 is conveyed with the plural roller pairs 23C, and stored temporarily in a switchback storage section 70, and thereafter, the conveyance direction is inverted and the recording paper is discharged from a discharge outlet 72 to a tray 73.

Further, the image recording apparatus 10 is equipped with a reversal conveyance path 74 for double-sided recording. In the reversal conveyance path 74, a roller pair 74A is provided. The recording paper, on one surface of which has an image that has been recorded with the inkjet recording head 14, is conveyed to the reversal conveyance path 74, the back and front surfaces of the recording paper are inverted in the reversal conveyance path 74, and the recording paper is again fed to the main conveyance path 22. In this manner, images can be recorded on both surfaces of the recording paper. Further, the reversal conveyance path 74 is equipped with a decurling conveyance section 38 that reverses the curling direction (decurling processing) of the recording paper, one surface (ink receiving layer at the resin layer B side) of which has the image that has been recorded with the inkjet recording head 14, and the curling direction is corrected in a concave posture such that the recorded surface (resin layer B side) of the recording paper faces inward. In the decurling conveyance section 38, the recording paper of which upper surface (recorded surface) is curled in a convex posture or in an unevenly concave posture owing to the recording of the image thereon is subjected to a decurling processing to curl the upper surface in a concave posture in the reversal conveyance path 74. Thereafter, the front and back surfaces are inverted in the reversal conveyance path 74, and the recording paper is conveyed again to the main conveyance path 22, thereby forming the recording paper in a convex-curled state.

The roller pairs 23A in the main conveyance path 22, and the roller pair 74A in the reversal conveyance path 74 are rotated by the drive force transmitted via the drive transmission path 84A from a motor 82A, and roller pairs 23B in the curving section 22B is rotated by the drive force transmitted via the drive transmission path 84B from a motor 82B. That is, in the present exemplary embodiment, the drive source and the drive path for driving the roller pairs 23A and the roller pair 74A are independent from the drive source and the drive path for driving the roller pairs 23B.

Further, the image recording apparatus 10 has a sheet feed unit 24 that feeds sheet-like recording paper PS, and/or a first roll paper feed unit 26 and a second roll paper feed unit 28 that feed elongated recording sheets, respectively. The sheet feed unit 24 has a sheet feed cassette 25 that stores recording paper therein such that the upper surface side of the recording paper is openable to the atmosphere.

For example, the sheet feed cassette 25 is capable of accommodating sheet-like recording paper with different sizes by adjusting the position of an inner partition or the like. The sheet feed cassette 25 is equipped with plural mechanical switches (not shown) for detecting the size of sheet-like recording paper PS accommodated in the cassette 25. The plural mechanical switches are arranged such that the combination of the on-state and off-state of the switches are changed in accordance with the size of the sheet-like recording paper PS when the paper is brought into contact with the mechanical switches, thereby detecting the size of the sheet-like recording paper PS accommodated in the cassette in accordance with the combination of the on-state and off-state of the mechanical switches.

For, example, the first roll paper feed unit 26 and the second roll paper feed unit 28 are capable of accommodating rolls of elongated recording paper 27 with different widths from 102 mm to 254 mm in the units. The first roll paper feed unit 26 and the second roll paper feed unit 28 are also equipped with plural mechanical switches (not shown) for detecting the width of the roll-shaped recording paper 27 accommodated in the units. Further, the first roll paper feed unit 26 and the second roll paper feed unit 28 are also equipped with a paper-remaining amount detecting sensor 29 for detecting the amount of remaining paper based on the thickness of the roll-shaped recording paper 27, respectively. Alternatively, the amount of remaining paper may be detected on the basis of the weight of the roll-shaped recording paper.

The image recording apparatus 10 has a sheet conveyance section 30 through which the sheet-like recording paper PS fed from the sheet feed unit 24 is conveyed, a first roll sheet conveyance section 32 through which a part of elongated roll-shaped recording paper PR1 unrolled from a first roll paper feed unit 26, and a second roll sheet conveyance section 34 through which a part of elongated roll-shaped recording paper PR2 unrolled from a second roll paper feed unit 28 (hereinafter, recording paper P as a general term for the recording paper PS, PR1 and PR2 is used for convenience of explanation).

Moreover, the image recording apparatus 10 has a sub-scanning roller 40 that feeds the recording paper P conveyed from the sheet feed unit 24, the first roll paper feed unit 26, the second roll paper feed unit 28 and the reversal conveyance path 74 to the main conveyance path 22. The sheet-like recording paper PS, the elongated roll-shaped recording paper PR1 and the elongated roll-shaped recording paper PR2 are selectively conveyed to the main conveyance path 22 through the sub-scanning roller 40.

The recording paper P is an inkjet recording medium, in which ink receiving layers are formed at both sides of resin coated paper (support), respectively, the resin coated paper having a resin layer A of thickness "a" at one side of base paper, and a resin layer B thinner than the thickness "a" by a thickness of 3 μm to 20 μm at the other side of the base paper. The details of the inkjet recording paper are as described in the above. Recording is performed first at the resin layer B side with a thinner thickness, thereby being capable of preventing the occurrence of curl. The recording is performed by the use of the image recording apparatus according to the present exemplary embodiment, whereby the occurrence of curling can be further suppressed and image can be recorded more stably.

For example, since coating layers containing water-absorptive silica particles are formed on both surfaces of paper generally used for photographic prints, when drying of one surface of the recording paper proceeds, the coating layer of this surface side becomes contracted, resulting in curling of this surface in a concave posture. Similarly, in the case of plain paper, when one surface of the paper is exposed to the atmosphere, drying of this surface proceeds and the contraction of paper fibers proceeds, resulting in curling of this surface in a concave posture. Further, paper used for recent photo books having coating layers containing water-absorptive silica particles on both surfaces thereof has also similar characteristics. Furthermore, in the case of the roll-shaped recording paper 27, the inner surface of the rolled paper has a curling tendency in a concave posture, since the paper is rolled in a roll shape. Accordingly, a suction-conveyance unit 42 is formed in the main conveyance path 22 to maintain the distance between the recording paper and the inkjet recording head 14, while the flatness of the recording paper to be conveyed to the image forming position for forming an image with the inkjet recording head 14 is maintained. The recording paper P is suction-conveyed by the suction-conveyance unit 42 to the region where an image is recorded with the image recording unit 12 (namely, directly below the inkjet recording head 14), while the recording paper P fed from the sub-scanning roller 40 is suctioned.

Mechanism of Suction-Conveyance Unit

Figure 2:
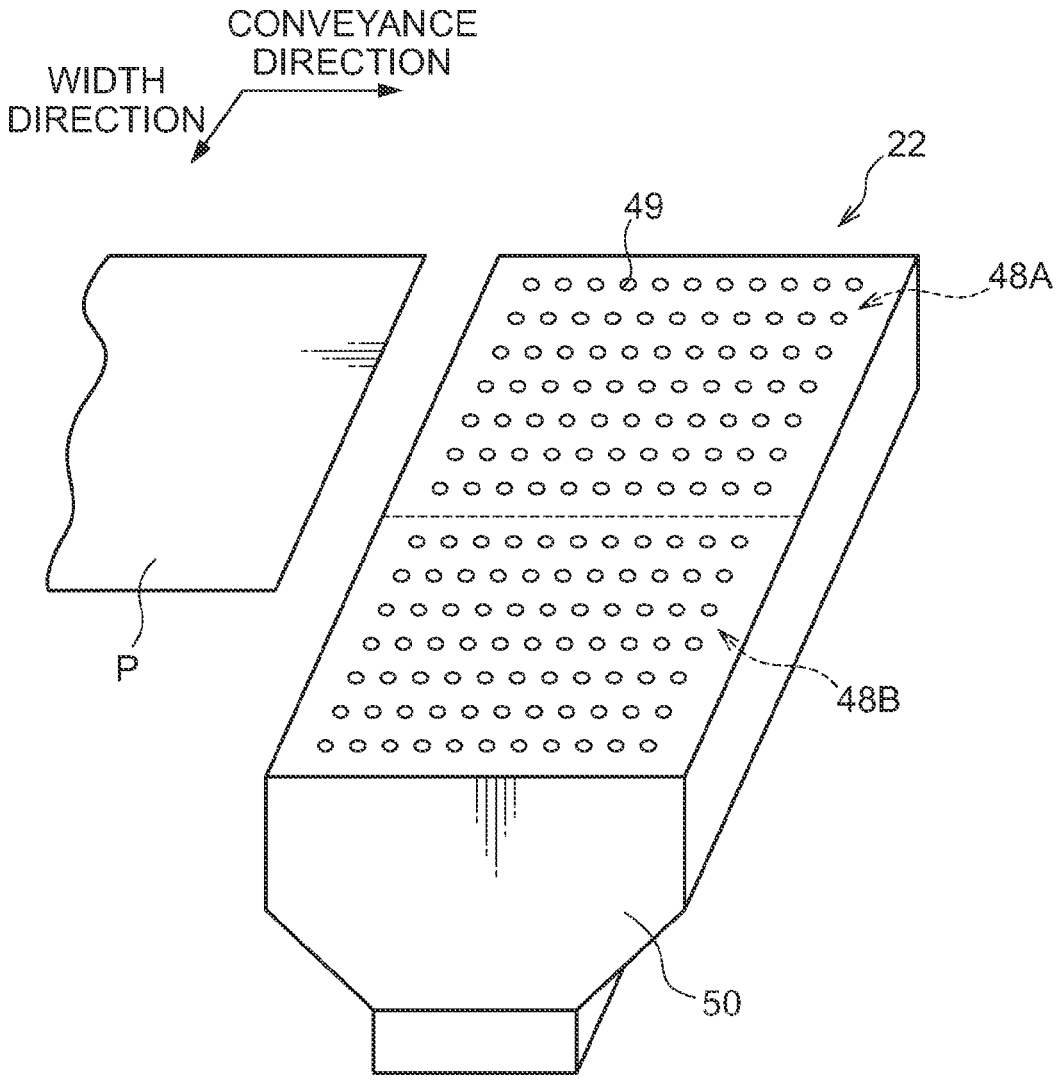
FIG. 2 is a perspective view showing the configuration of the suction-conveyance unit according to an exemplary embodiment of the invention.
Figure 3:
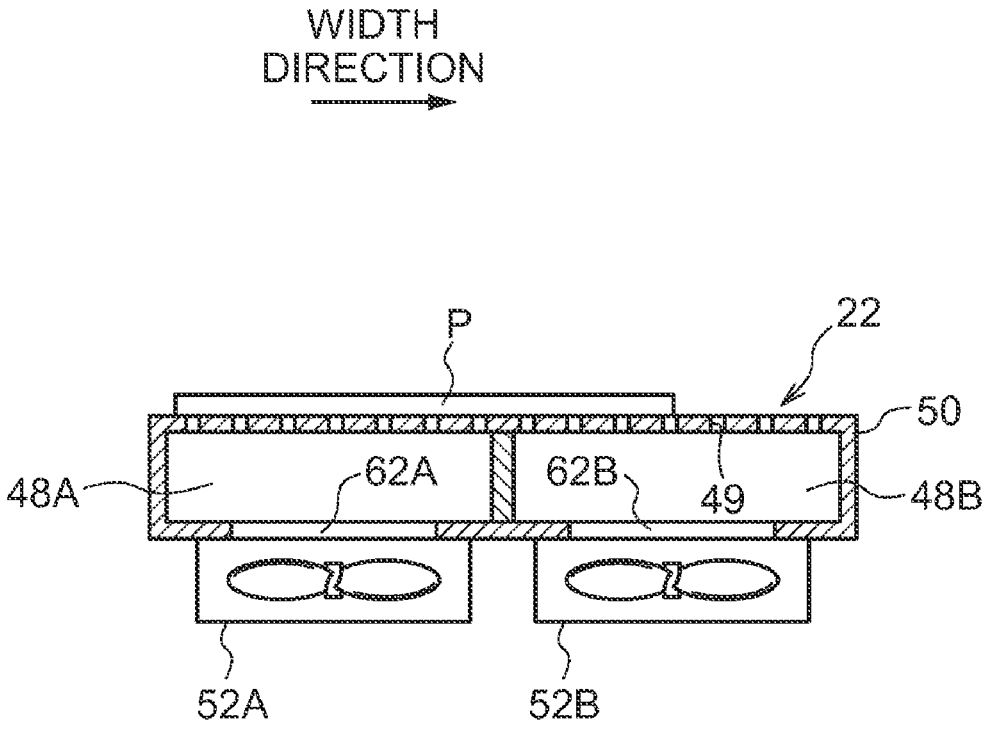
FIG. 3 is a sectional view showing the configuration of the suction-conveyance unit according to an exemplary embodiment of the invention.

FIG. 2 shows a perspective view of the suction-conveyance unit 42, and FIG. 3 shows a cross-sectional view in the width direction of the suction-conveyance unit 42.

The suction-conveyance unit 42 has an air chamber-forming member 50, which forms two air chambers 48A and 48B in the width direction of the recording paper P, and the main conveyance path 22 is provided on the upper surface of the chambers, and two suction fans 52A and 52B for performing negative pressure suctioning are arranged in the two air chambers 48A and 48B, respectively.

The width of the air chamber-forming member 50 in the width direction of the recording paper P is wider than the maximum width of the recording paper P usable in the image recording apparatus 10, and a large number of suction holes 49 arranged in the upper surface of the air chamber-forming member 50, on which the main conveyance path 22 is provided, are arranged in such a manner that the recording paper is conveyed through the main conveyance path 22 on the upper side of the air chambers 48A and 48B. Further, openings 62A and 62B are provided in the bottom side of the air chamber-forming member 50, such that the suction fans 52A and 52B communicate with the air chambers 48A and 48B, respectively.

The recording paper P is suction-conveyed to the suction-conveyance unit 42 such that one end in the width direction of the recording paper P corresponds to the width direction of the air chamber-forming member 50.

When an image is to be recorded, the recording paper P, onto which an image is to be recorded, is conveyed to the main conveyance path 22 selectively from the sheet-like recording paper PS, the elongated roll-shaped recording paper PR1 and the elongated roll-shaped recording paper PR2. As shown in FIG. 2, in the suction-conveyance unit 42, the recording paper P is conveyed such that one end in the width direction of the recording paper P corresponds to the width direction of the air chamber-forming member 50. The recording paper P is apt to be slightly curled in a convex posture with respect to the main conveyance path 22 when suction force is not applied from the suction-conveyance unit 42.

Hot air from the dryer 18 is applied to the recording paper P, on which an image has been recorded, thereby solidifying ink droplets. Further, the elongated roll-shaped recording paper PR1 and the elongated recording paper PR2 are cut at the end thereof with the rear end cutter 17. The recording paper P passed through the rear end cutter 17 and the dryer 18 is conveyed to the curving section 22B, and is curved outward and is temporarily held by the curving section 22B. At this time, the recording paper P held in the curving section 22B is equivalent to one sheet of the recording paper in terms of the maximum recordable image, and when the recoding paper P is detected by the paper sensor 80, the recording paper only by one sheet in terms of the maximum image is conveyed by rotationally driving the roller pairs 23B by controlling the motor via a conveyance control unit (not shown), and the recording paper P is cut with the cutter 20 by being controlled via a cutter control unit (not shown) for each image. The recording paper P cut for each image is stored in the switch back accommodation section 70 once, and thereafter, is discharged onto the tray 73 from the paper discharge outlet 72 after the conveyance direction is inverted.

Meanwhile, when images are formed on both surfaces of the recording paper P, first, the recording paper is conveyed through the main conveyance path while the recording paper is suctioned from the resin layer A side (first suction-conveying step), an image is recorded by ejecting ink by the inkjet method onto the ink receiving layer at the resin layer B side of the recording paper suctioned to the conveyance path (first ink applying step), thereafter, the conveyance direction of the recording paper P passed through the rear end cutter 17 and the dryer 18 is inverted in the reverse direction, and the recording paper P is conveyed to the reversal conveyance path 74. At this time, the solvent contained in the ink droplets is absorbed in the ink receiving layer of the recording paper PS, and the upper side of the recording paper PS is elongated due to liquid-absorption as compared with the lower side of the recording paper PS. Accordingly, curling force acts on the upper surface side of the recording paper PS so as to to convex the recording paper. Further, the recording paper P is cut at least at the downstream side in the direction of conveyance of the image with the rear end cutter 17, and is formed in a predetermined size, and at least a part of the ink component in the recording medium is dried and removed by the dryer 18 (drying and removing step). In the reversal conveyance path 74, the recording paper is subjected to a decurling processing in the decurling conveyance section, and the curling direction is corrected such that the recording surface side faces inward in a concave posture (curl correction step). Thus, the curling direction of the recording paper which is subjected to the decurling processing in the decurling conveyance section 38 is reversed. That is, the recording paper in a state where the recording paper is discharged from decurling conveyance section 38 is concave with respect to the reversal conveyance path 74, namely, is convexed with respect to the main conveyance path 22 when the recording medium is inverted through the reversal conveyance path 74 and is fed to the main conveyance path 22 again. Accordingly, when the second image recording after the image is recorded on the ink receiving layer at the resin layer B side, namely, when the recording medium is conveyed on the main conveyance path 22 in the image recording on the ink receiving layer at the resin layer A side, the recording paper is postured along the shape of the conveyance path such that the ink receiving layer at the layer A side faces to the main conveyance path 22 (second suction conveyance step), in a manner similar to the first image recording, so that the tip end of the recoding paper does not lift from the main conveyance path 22. Then, an image is recorded by applying ink by the inkjet method to the ink receiving layer, on which an image has not been recorded, at the resin layer A side (second ink applying step).

In the present exemplary embodiment, good images can be formed on the recording paper P with different widths in such a simple mechanism that two air chambers 48A and 48B having the plural suction holes 49 arranged so as to face the conveyance path of recording paper P in the width direction thereof, and two suction fans 52A and 52B provided for the two air chambers 48A and 48B, respectively, are arranged at the image forming position of the image recording section 12, and the number of the suction fans 52A and 52B is changed in accordance with the width of the recording paper P, on which an image is to be formed.

In the above exemplary embodiment, the case where the recording paper equivalent to the size of one sheet is held in the curving section 22B is detected by the paper sensor 80 is described, but the invention is not limited to the embodiment. For example, in the above exemplary embodiment, the case where the difference between the conveyed length of the recording paper P by the roller pairs 23A and the conveyed length of the recording paper P by the roller pairs 23B is determined, and the length of the recording paper held may be determined. Further, in the above exemplary embodiment, the suction-conveyance unit 42 including two air chambers 48A and 48B in the width direction of the recording paper P, and two suction fans 52A and 52B provided for the two air chambers 48A and 48B, respectively, is described, but two or more chambers and fans may be arranged, and the number of the fans to be driven may be increased with an increase in the width of the recording paper.

EXAMPLES

Hereafter, the invention is described in accordance with the examples. However, the invention is not limited to the following examples unless departing from the spirit of the invention. In the examples, the case where an inkjet recording sheet is prepared as an inkjet recording medium is described. In addition, the "part" is a mass basis, unless otherwise specified.

Manufacture of Support

Manufacture of Support A

LBKP (50 parts) formed from acacia and 50 parts of LBKP formed from aspen were respectively beaten to a Canadian freeness of 300 ml in a disk refiner to form a pulp slurry.

Subsequently, to the pulp slurry thus obtained, were added 1.3% by mass of a cationic starch (CATO 304L (trade name) manufactured by Nippon NSC Ltd.), 0.15% by mass of anionic polyacrylamide (POLYACRON ST-13 (trade name) manufactured by Seiko PMC Corporation), 0.29% by mass of alkyl ketenedimer (SIZEPINE K (trade name) manufactured by Arakawa Chemical Industries, Ltd.), 0.29% by mass of epoxidized behenic acid amide, and 0.32% by mass of polyamide polyamine epichlorohydrin (ARAFIX 100 (trade name) manufactured by Arakawa Chemical Industries, Ltd.), with respect to the amount of the pulp, and thereafter, 0.12% by mass of a defoaming agent was added thereto.

The pulp slurry was made into paper with a Fourdrinier paper machine, and in the drying process, the felt surface of the web was pressed against a drum dryer cylinder via a dryer canvas, and dried at the dryer canvas tension set to 1.6 kg/cm to form base paper. Thereafter, each of the two surfaces of the base paper was coated with polyvinyl alcohol (KL-118 (trade name) manufactured by Kuraray Co., Ltd.) in an amount of 1 g/m$^2$ by size pressing, dried and calender-processed to obtain substrate paper. The basis weight of the substrate paper thus obtained was 160 g/m$^2$ and the thickness thereof was 155 μm.

After one surface of the substrate paper was subjected to a corona discharge treatment, a low density polyethylene, which was adjusted to contain 10% by mass of anatase type titanium dioxide, 0.3% by mass of ultramarine blue (manufactured by Tokyo Printing Ink Mfg. Co., Ltd.), and further contain 0.08% by mass of a fluorescent brightening agent (WHITEFLOUR PSN CONC (trade name) manufactured by Nippon Chemical Works Co., Ltd.), and which has a MFR (melt flow rate) of 3.8 was extruded to a thickness of 25 μm by the use of a melt extruder, thereby forming a high-glossy thermoplastic resin layer (resin layer B). Hereinafter, the high-glossy surface is referred to as the "front surface".

Further, the opposite surface of the substrate paper was subjected to a treatment similar to the above treatment, and a thermoplastic resin layer (resin layer A) having a thickness of 30 μm ("a" in thickness) was obtained. Hereinafter, the surface is referred to as the "back surface".

Manufacture of Support B

Support B was manufactured in a manner similar to the manufacture of the support A, except that the thickness of the resin layer A on the back surface was changed to 35 μm.

Manufacture of Support C

Support C was manufactured in a manner similar to the manufacture of the support A, except that the basis weight of the base paper was changed to 175 g/m$^2$, and the thickness of the resin layer A on the back surface was changed to 40 μm.

Manufacture of Support D

Support D was manufactured in a manner similar to the manufacture of the support A, except that the thickness of the resin layer A on the back surface was changed to 55 μm.

Manufacture of Support E

Support E was manufactured in a manner similar to the manufacture of the support A, except that the thickness of the resin layer A on the back surface was changed to 25 μm.

Manufacture of Support F

Support F was manufactured in a manner similar to the manufacture of the support A, except that the basis weight of the base paper was changed to 220 g/m$^2$, and the thickness of the resin layer A on the back surface was changed to 25 μm.

Manufacture of Support G

Support G was manufactured in a manner similar to the manufacture of the support C, except that the thickness of the resin layer B on the front surface was changed to 30 μm, and the thickness of the resin layer A on the back surface was changed to 55 μm.

Example 1

Preparation of Coating Liquid for Ink Receiving Layer (1) Vapor phase process silica, (2) ion exchange water and (3) SHALLOL DC-902P ((trade name) manufactured by Dai-Ichi Kogyo Seiyaku Co., Ltd.) were mixed and dispersed by an ultrasonic dispersing machine (manufactured by MST Co., Ltd.), and the obtained dispersion was heated to 45° C., and was maintained for 20 hours to form a composition. Thereafter, (4) boric acid, (5) a 7% aqueous solution of polyvinyl alcohol, and (6) a 10% aqueous solution of a surfactant were added to the composition at 30° C., thereby obtaining a coating liquid A1 for ink receiving layer having the following composition.

Composition of Coating Liquid A1 for Ink Receiving Layer

| | | |
|---|---|---|
| (1) | Vapor phase process silica (inorganic particles) ((AEROSIL300SV) available from Nippon Aerosil Co., Ltd.) | 10.0 parts |
| (2) | Ion exchanged water | 56 parts |
| (3) | SHALLOL DC-902P (trade Name) (51.5% aqueous solution) (dispersing agent; manufactured by Dai-Ichi Kogyo Seiyaku Co., Ltd.) | 0.78 part |
| (4) | Boric acid (crosslinking agent) | 0.37 part |
| (5) | Polyvinyl alcohol (PVA-235 (trade name) manufactured by Kuraray Co., Ltd.) (7% aqueous solution) | 29 parts |
| (6) | Surfactant (EMULGEN 109P (trade name) manufactured by Kao Corporation) (10% aqueous solution) | 0.6 part |

Manufacture of Inkjet Recording Sheet

After the surface of the resin layer at one side of the support A was subjected to a corona discharge treatment, the coating liquid A1 for ink receiving layer was applied on the surface in an amount of 200 ml/m$^2$ with a slide bead coater, and was dried at 80° C. for 10 minutes (air flow rate: 3 m/minute) with a heat dryer, thereby forming an ink receiving layer. Thereafter, in a manner similar to the above method, the coating liquid A1 for ink receiving layer was applied in an amount of 200 ml/m$^2$ on the resin layer surface at the other side, and was dried at 80° C. for 10 minutes (air flow rate: 3 m/minute) with a heat dryer, thereby forming an ink receiving layer.

In this way, an inkjet recording sheet for double-sided recording, which has ink receiving layers at both sides of the support was prepared. The thicknesses of the ink receiving layers on the front and back surfaces of the support A were 35 μm, respectively.

Recording of Image

The density of grey solid images was adjusted by the use of an inkjet printer (PM970C (trade name) manufactured by Seiko Epson Corporation) under the conditions of 23° C. and 30% RH. The density was adjusted such that the visual reflection density of 1.5±0.1 was obtained with the use of a densitometer (X-rite 310TR) by controlling the gradation value of image data. At this time, the weights (g) of inkjet recording sheets before recording and after recording were measured with a precise balance, and the quantity of the ink droplets spotted on the ink receiving layers being 12 g/m$^2$ was confirmed.

Subsequently, after the inkjet recording sheet thus obtained as described above was cut into L size, and the sheet was hung, and allowed to stand under the conditions of 23° C. and 30% RH over night, a grey solid image was recorded on the entire surface (borderless print setting) of the ink receiving layer formed on the resin layer B on the front surface of the inkjet recording sheet. At this time, the time required for recording from the start to the completion of recording the solid image was 35 seconds. Subsequently, immediately after (within 10 seconds) completion of the recording of the solid image in the above, recording on the ink receiving layer prepared on the resin layer A formed at the back surface of the support was started in a similar manner to the above, and a grey solid image was recorded. Here, for the ink receiving layers on both surfaces, the start of recording was counted on the basis of the time when the first ink droplet was spotted on the ink receiving layer.

In this way, image samples were prepared.

Evaluation 1

Image samples having solid images on both surfaces of the recording media were subjected to the following evaluation. The results of the evaluation are shown in Table 1 below.

1. Edge Stain at the Time of Recording on Back Surface

When recording on the back surface was performed, ink stain adhered onto the edges of inkjet recording sheets resulting from the extent or posture of the curling of the sheets was visually observed, and the degree of ink stain was rated in accordance with the following evaluation criteria:

Valuation Criteria

A: no adhesion of ink stain was observed at all;

B: ink stain was slightly adhered, but was in practically acceptable range; and

C: ink stain was considerably adhered, and was not in practically acceptable range.

2. Curling after Double-Sided Recording

After solid images were recorded on both surfaces of the inkjet recording sheet, the recording sheet was hung, and was allowed to stand under the conditions of 23° C. and 30% RH over night. The sample allowed to stand was placed downward on the surface of a table so as to bring the front surface of the sample into contact with the surface of the table, the heights of the four corners of the sample sheet from the surface of the table were measured, and the measured values were averaged. The averaged values were used as curl values, and the curling was rated based on the obtained averaged values in accordance with the following evaluation criteria:

Evaluation Criteria:

A: curl value is less than 2 mm, and occurrence of curling was hardly observed;

B: curl value is 2 mm or more and less than 5 mm, and curling is practically in the acceptable range;

C: curl value is 5 mm or more and less than 10 mm, and occurrence of curling is observed; and D: curl value is 10 mm or more, and occurrence of curling is considerably observed.

3. Conveying Characteristics

Occurrence of abnormalities such as skew conveyance at the time of recording on the front surface or the back surface was observed, and was rated in accordance with the following evaluation criteria:

Evaluation Criteria

A: no problems in conveying characteristics are observed;

B: skew conveyance occurs slightly, but is hardly observable; and

C: problems in conveying characteristics such as considerable skew conveyance or paper jam Occur.

Example 2

An inkjet recording sheet was prepared and evaluated in a manner similar to Example 1, except that Support B was used in place of Support A. The results of evaluation are shown in Table 1 below.

Example 3

An inkjet recording sheet was prepared and evaluated in a manner similar to Example 1, except that Support B was used in place of Support A, and the thicknesses of the ink receiving layers on the front and back sides were changed to 30 μm, respectively. The results of evaluation are shown in Table 1 below.

Example 4

An inkjet recording sheet was prepared and evaluated in a manner similar to Example 1, except that Support C was used in place of Support A. The results of evaluation are shown in Table 1 below.

Comparative Example 1

An inkjet recording sheet was prepared and evaluated in a manner similar to Example 1, except that Support D was used in place of Support A. The results of evaluation are shown in Table 1 below.

Comparative Example 2

An inkjet recording sheet was prepared and evaluated in a manner similar to Example 1, except that Support E was used in place of Support A. The results of evaluation are shown in Table 1 below.

Comparative Example 3

An inkjet recording sheet was prepared and evaluated in a manner similar to Example 1, except that Support F was used in place of Support A. The results of evaluation are shown in Table 1 below.

Comparative Example 4

An inkjet recording sheet was prepared and evaluated in a manner similar to Example 1, except that Support G was used in place of Support A. The results of evaluation are shown in Table 1 below.

TABLE 1

| | Inkjet Recording Sheet | | | | | Evaluation | | |
|---|---|---|---|---|---|---|---|---|
| | Resin Layer B (Front Side) [μm] | Resin Layer A (Back Side) [μm] | Difference in Layer Thickness B – A [μm] | Ink Receiving Layer [μm] | Basis Weight of Base Paper [g/m$^2$] | Sheet Edge Stain | Curling | Conveyance Characteristics |
| Example 1 | 25 | 30 | 5 | 35 | 160 | A | A | A |
| Example 2 | 25 | 35 | 10 | 35 | 160 | A | A | A |
| Example 3 | 25 | 35 | 10 | 30 | 160 | A | B | A |
| Example 4 | 25 | 40 | 15 | 35 | 175 | A | B | A |

TABLE 1-continued

| | Inkjet Recording Sheet | | | | | Evaluation | | |
|---|---|---|---|---|---|---|---|---|
| | Resin Layer B (Front Side) [μm] | Resin Layer A (Back Side) [μm] | Difference in Layer Thickness B – A [μm] | Ink Receiving Layer [μm] | Basis Weight of Base Paper [g/m$^2$] | Sheet Edge Stain | Curling | Conveyance Characteristics |
| Comparative Example 1 | 25 | 55 | 30 | 35 | 160 | A | C | A |
| Comparative Example 2 | 25 | 25 | 0 | 35 | 160 | C | D | A |
| Comparative Example 3 | 25 | 25 | 0 | 35 | 220 | — | A | C |
| Comparative Example 4 | 30 | 55 | 25 | 35 | 175 | B | C | A |

As shown in Table 1, in Examples, occurrence of curling can be prevented even after solid images are recorded only one surface side in the double-sided recording, the sheets can be favorably conveyed at the time when images are recorded on the back surface side, and further, contact of the sheets with the head or other members can be avoided, and the occurrence of ink stain at the edge of the sheets can also be prevented. On the other hand, in Comparative Examples 1-2, effect of preventing occurrence of curling after one-sided recording or double-sided recording was not sufficient, and in Comparative Example 3, problems in sheet conveyance arose.

Examples 5-8 and Comparative Examples 5-8

Preparation of Roll-Shaped Recording Paper

In each of Examples 5-8 and Comparative Examples 5-8, elongated roll-shaped inkjet recording paper having ink receiving layers with dry thicknesses as shown in Table 2 was prepared in a manner similar to each of Examples 1-4 and Comparative Examples 1-4, except that Supports A-G prepared in an elongated shape were used as supports. The elongated inkjet recording paper was rolled into a roll-shaped form, and was cut into of a size with the width of 152 mm and the length of 100 m, so that roll-shaped recording paper of the elongated inkjet recording paper was formed. At this time, the inkjet recording paper is rolled in a roll-shape such that the ink receiving layer formed on the resin layer A at the back surface side of the support faces toward the core of the roll.

Recording of Image

The roll-shaped recording paper thus obtained was loaded as a rolled sample for evaluation in the image recording apparatus as shown in FIG. 1, and the density of grey solid images was adjusted under the conditions of 23° C. and 30% RH. The density was adjusted such that the visual reflection density of 1.5±0.1 was obtained with the use of a densitometer (X-rite 310TR) by controlling the gradation value of image data. At this time, the weights (g) of inkjet recording sheets before recording and after recording were measured with a precise balance, thereby confirming the quantity of the ink droplets spotted on the ink receiving layers being 12 g/m$^2$. In addition, the details of the structure of the image recording apparatus is as described above, and as the inks for recording images, inks for FRONTIER DRY MINI-LAB DL410 ((trade name) manufactured by FujiFilm Corporation) with four colors of Y (yellow), M (magenta), C (cyan) and K (black) were used.

Figure 4:
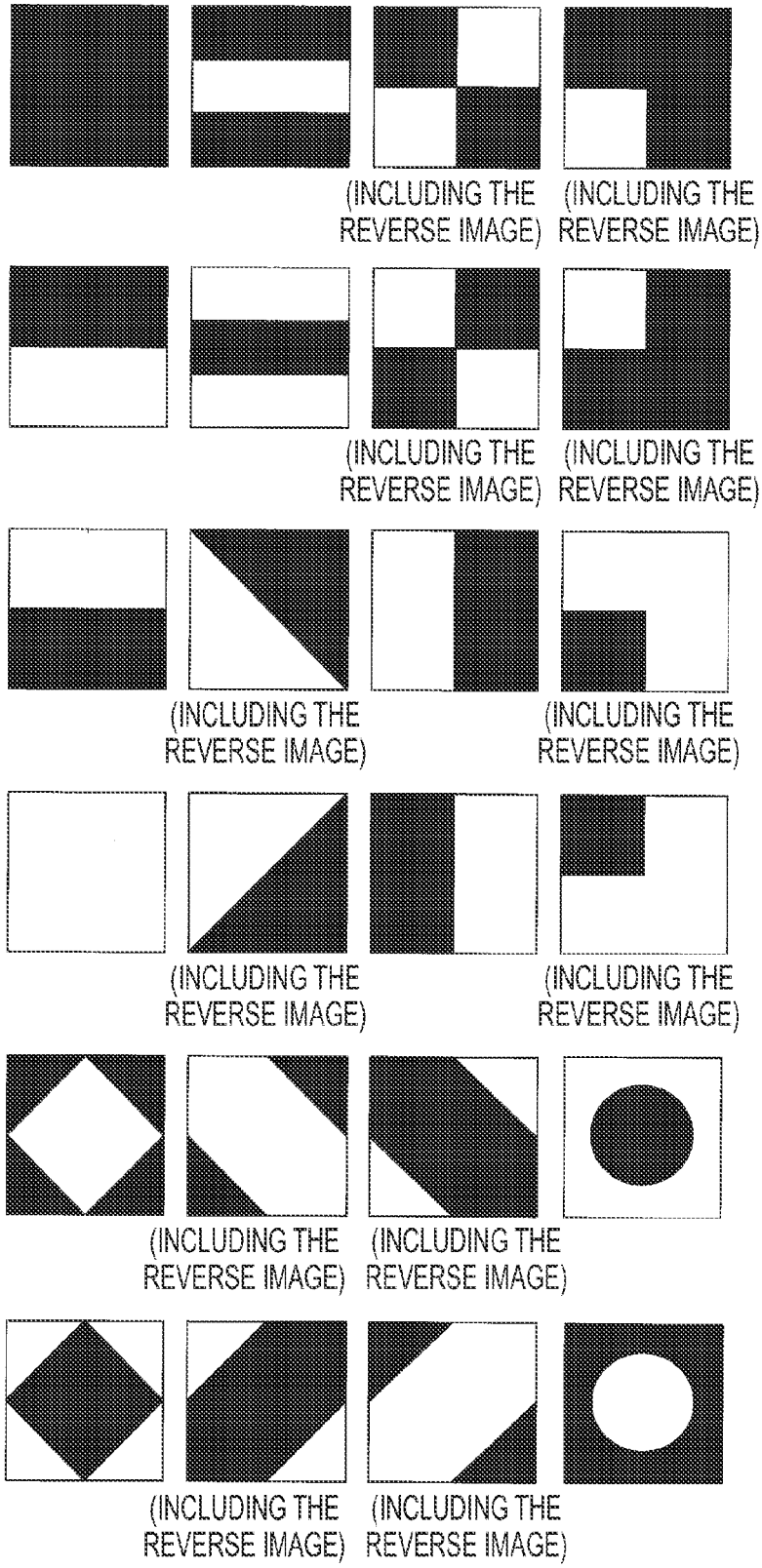
FIG. 4 is a drawing showing image patterns for evaluation.

Subsequently, after the rolled recording paper thus obtained was allowed to stand under the conditions of 23° C. and 30% RH over night for temperature control and humidity control, first, 10 images for each of 36 types of images as shown in FIG. 4 were consecutively recorded in an arbitrary order on the entire surface of the ink receiving layer (borderless print setting) formed on the resin layer B of the front side of the support at an average conveyance speed of 1,000 mm/minute, and thereafter, the image-recorded recording paper was subjected to a drying treatment by applying air at 70° C. for 10 second. Each time the image pattern is recorded and dried, the rear end of each image (namely, the downstream side of each image pattern on the recording paper) was cut at a predetermined position. Thereafter, the recording paper, on which one image pattern was recorded, was inversely conveyed, and the inversely conveyed recording paper was subjected to a decurling processing in the reversal conveyance path. The curling direction of the recording paper is reversed by the decurling processing, and the curling of the recording paper is corrected in a concave posture with respect to the reversal conveyance path. At this time, the time required for recording from the start to the completion of recording one pattern image (ten images) was 120 seconds. Subsequently, after the completion of the recording (within 10 seconds), ten images of the image patterns as shown in FIG. 4 were similarly recorded on the ink receiving layer on the resin layer A formed on the back surface side of the support, and thereafter, the recording paper was cut for each image.

Here, the start of recording was defined to be the time when the first ink droplet was spotted on the ink receiving layer.

In this way, image samples were prepared.

Evaluation 2

Image samples having solid images on both surfaces of the recording media in the above were subjected to the following evaluation. The results of the evaluation are shown in Table 2 below.

4. Conveyance Characteristics

The conveyance characteristics of the recording paper before and after 36 types of image patterns as shown in FIG. 4 were recorded on both surfaces were visually checked, and were evaluated in accordance with the following evaluation criteria.

Evaluation Criteria

The conveyance characteristics are defined to be good, only when all ten sheets for each image pattern are suitably conveyed, and the conveyance characteristics are determined based on the number of poor conveyance characteristics with respect to 36 patterns in accordance with the following criteria:

A: all the patterns are suitably conveyed;

B: two or less patterns have poor conveyance characteristics such as paper jam due to poor suctioning or ink stain at paper edge;

C: 3 to 6 patterns have poor conveyance characteristics such as paper jam due to poor suctioning or ink stain at paper edge; and D: 7 or more patterns have poor conveyance characteristics such as paper jam due to poor suctioning or ink stain at paper edge.

5. Curling after Double-Sided Recording

After images were recorded on both sides of the inkjet recording sheet, the printed sample obtained by being cut for each image was hung, and was allowed to stand under the conditions of 23° C. and 30% RH over night. The printed sample allowed to stand was placed in the direction where the four corners were curled upward on the surface of a table. At this time, the heights of the four corners of the sample sheet from the surface of the table were measured, and the measured values were averaged. The average values were used as the curl values, and the curling was rated based on the obtained averaged values in accordance with the following evaluation criteria:

Evaluation Criteria:

A: curl value is less than 2 mm, and occurrence of curling was hardly observed;

B: curl value was 2 mm or more and less than 5 mm, and curling was in the practically acceptable range;

C: curl value was 5 mm or more and less than 10 mm, and occurrence of curling was observed; and D: curl value was 10 mm or more, and occurrence of curling was considerably observed.

TABLE 2

| | Roll-shaped Inkjet Recording Paper | | | | | Evaluation | |
|---|---|---|---|---|---|---|---|
| | Resin Layer B (Front Side) [μm] | Resin Layer A (Back Side) [μm] | Difference in Layer Thickness B − A [μm] | Ink Receiving Layer [μm] | Basis Weight of Base Paper [g/m$^2$] | Conveyance Characteristic | Curling |
| Example 5 | 25 | 30 | 5 | 35 | 160 | A | A |
| Example 6 | 25 | 35 | 10 | 35 | 160 | A | A |
| Example 7 | 25 | 35 | 10 | 30 | 160 | A | B |
| Example 8 | 25 | 40 | 15 | 35 | 175 | A | B |
| Comparative Example 5 | 25 | 55 | 30 | 35 | 160 | A | C |
| Comparative Example 6 | 25 | 25 | 0 | 35 | 160 | D | A |
| Comparative Example 7 | 25 | 25 | 0 | 35 | 220 | D | A |
| Comparative Example 8 | 30 | 55 | 25 | 35 | 175 | C | B |

As shown in Table 2, in Examples, occurrence of curling are prevented even when any of various image patterns are recorded, and the recording sheet can be suitably conveyed when the images are recorded on the back surface side, whereas in Comparative Examples, problems in conveyance arise.

What is claimed is:

1. An inkjet recording method, comprising:

preparing an inkjet recording medium which comprises a resin coated paper having a resin layer A of thickness "a" at one side of a base paper, and a resin layer B that is thinner than the thickness "a" by a thickness of 3 μm to 20 μm at the other side of the base paper, and ink receiving layers each comprising an inorganic pigment and a binder and being provided at either side of the resin coated paper, each of the resin layer A and the resin layer B being provided adjacent to the base paper;

recording an image on an ink receiving layer at the resin layer B side of the resin coated paper; and subsequently recording an image on an ink receiving layer at the resin layer A side of the resin coated paper.

2. The inkjet recording method according to claim 1, wherein the resin layer B is thinner than the resin layer A by a thickness of 5 μm to 10 μm.

3. The inkjet recording method according to claim 1, wherein the thickness of each of the ink receiving layers formed at either side of the resin coated paper is from 20 μm to 50 μm.

4. The inkjet recording method according to claim 1, wherein the thickness of each of the ink receiving layers formed at either side of the resin coated paper is from 25 μm to 40 μm.

5. The inkjet recording method according to claim 1, wherein the recording on the ink receiving layer at the resin layer A side is started within 30 seconds after completion of the recording on the ink receiving layer at the resin layer B side.

6. The inkjet recording method according to claim 1, wherein the basis weight of the base paper is 180 g/m$^2$ or less.

7. The inkjet recording method according to claim 1, wherein the amount of ink ejected is at least 7 g/m$^2$ or more, when an image is recorded on the ink receiving layer at the resin layer B side.

8. The inkjet recording method according to claim 1, wherein the time required for recording an image on the ink receiving layer at the resin layer B side is within 120 seconds from the start of recording.

9. An inkjet recording method, comprising:

preparing an inkjet recording medium which comprises a resin coated paper having a resin layer A of thickness "a" at one side of a base paper, and a resin layer B that is thinner than the thickness "a" by a thickness of 3 μm to 20 μm at the other side of the base paper, and ink receiving layers each comprising an inorganic pigment and a binder and being provided at either side of the resin coated paper, each of the resin layer A and the resin layer B being provided adjacent to the base paper;

conveying the inkjet recording medium while the inkjet recording medium is suctioned to a conveyance path from the resin layer A side;

recording an image by applying ink by an inkjet recording method onto the ink receiving layer at the resin layer B side of the inkjet recording medium suctioned to the conveyance path;

correcting a curling direction of the inkjet recording medium, on which the image has been recorded, in a direction in which the recorded surface side faces inward in a concave posture;

conveying the curl-corrected inkjet recording medium while it is suctioned to the conveyance path such that the ink receiving layer on which the image has been recorded at the resin layer B side faces the conveyance path; and recording an image by applying ink by an inkjet recording method to the ink receiving layer on which an image has not yet been recorded at the resin layer A side of the inkjet recording medium suctioned to the conveyance path.

10. An inkjet recording method, comprising:

preparing an inkjet recording medium which comprises a resin coated paper having a resin layer A of thickness "a" at one side of a base paper, and a resin layer B that is thinner than the thickness "a" by a thickness of 3 μm to 20 μm at the other side of the base paper, and ink receiving layers each comprising an inorganic pigment and a binder and being provided at either side of the resin coated paper, the inkjet recording medium being a roll of an elongated recording medium;

conveying a part of the roll of the recording medium while it is suctioned to a conveyance path from the resin layer A side;

recording an image by applying ink by an inkjet recording method onto the ink receiving layer at the resin layer B side of the recording medium suctioned to the conveyance path;

cutting the recording medium on which the image has been recorded to a predetermined size, at least at the downstream side in the conveyance direction of the image, to form a recording medium sheet;

drying and removing at least a part of ink components from the resulting recording medium sheet;

correcting a curling direction of the recording medium sheet after the drying and removal of the ink components, in the direction in which the recorded surface side faces inward in a concave posture;

conveying the curl-corrected recording medium while the recording medium is suctioned from the resin layer B side such that the front and back surfaces of the curl-corrected recording medium are inverted, and the ink receiving layer on which the image has been recorded at the resin layer B side faces the conveyance path; and recording an image by applying ink by an inkjet recording method onto the ink receiving layer on which an image has not yet been recorded at the resin layer A side of the inkjet recording medium suctioned to the conveyance path.

* * * * *